United States Patent [19]

Straitz, III

[11] 4,101,261

[45] Jul. 18, 1978

[54] FLARE GAS STACK WITH PURGE GAS CONSERVATION SYSTEM

[75] Inventor: John F. Straitz, III, Meadowbrook, Pa.

[73] Assignee: Combustion Unlimited Incorporated, Elkins Park, Pa.

[21] Appl. No.: 808,287

[22] Filed: Jun. 20, 1977

Related U.S. Application Data

[63] Continuation-in-part of Ser. No. 769,709, Feb. 17, 1977.

[51] Int. Cl.[2] ..... F23D 13/20

[52] U.S. Cl. ..... 431/202; 23/277 C; 431/13

[58] Field of Search ..... 431/202, 5, 13, 14, 431/29; 23/277 C; 137/91

[56] References Cited

U.S. PATENT DOCUMENTS

| | | | |
|---|---|---|---|
| 2,888,981 | 6/1959 | Ripple | 431/202 X |
| 3,901,643 | 8/1975 | Reed et al. | 431/202 |
| 3,994,663 | 11/1976 | Reed | 431/202 X |

*Primary Examiner*—Edward G. Favors
*Attorney, Agent, or Firm*—Zachary T. Wobensmith, 2nd; Zachary T. Wobensmith, III

[57] ABSTRACT

A flare gas stack is described with a purge gas conservation system adapted to control the flow of purge gas in accordance with the specific gravity of the purge gas, and prevailing conditions including cutting off the purge gas flow when conditions of waste gas flow and wind speed near the top of the stack permit. Provisions are made for visual observation of the waste gas flow, purge gas flow and purge failure.

12 Claims, 2 Drawing Figures

S.G.
V
R

FLARE GAS STACK WITH PURGE GAS CONSERVATION SYSTEM

CROSS REFERENCE TO RELATED APPLICATION

This application is a continuation in part of my prior application filed Feb. 17, 1977, Ser. No. 769,709 for Flare Gas Stack with Purge Control.

BACKGROUND OF THE INVENTION

1. Field of the Invention

This invention relates to flare gas stack for waste combustible gas from industrial processes including oil refineries and more particularly to a purge gas conservation system with provisions for controlling the flow of purge gas in accordance with the prevailing conditions including cutting off the purge gas flow when conditions permit.

2. Description of the Prior Art

It has heretofore been proposed to supply purge gas to a flare stack when waste combustible gas is not flowing to the stack and thereby prevent the occurrence of explosions in the stack.

No satisfactory provisions have heretofore been made by others looking to conservation of purge gas when conditions do not justify the supplying of purge gas.

In my prior application for Letters Patent filed Feb. 17, 1977, Ser. No. 769,709, for Flare Gas Stack with Purge Control provisions are made for start up, steady state or transient purge gas control and for failure of the purge gas supply, and take into account variable wind speed at or near the top of the stack and other conditions with provisions for pilot burner gas supply and ignition, and indication of the prevailing conditions.

SUMMARY OF THE INVENTION

In accordance with the present invention a flare gas stack with a purge gas supply has provisions for controlling the purge gas flow, including variations of specific gravities of the purge gas, and including shutting off the purge gas supply when conditions permit, thereby effecting substantial saving of purge gas without the hazard of explosions in the stack. The control system includes a waste gas sensor activated by flare gas flow to the stack and a wind speed sensor for purge gas delivery control, the wind speed, purge supply and purge failure and specific gravity preferably being shown on an indicator, and with manual provisions for override of the control system.

It is the principal object of the present invention to provide a purge gas conservation system for flare gas stacks which will reduce unnecessary delivery of purge gas to a flare stack as measured by the wind speed at or near the top of the stack.

It is a further object of the invention to provide a purge gas conservation system for flare gas stacks in which the flow of the flare gas to the stack is utilized for control purposes.

It is a further object of the invention to vary the flow of purge gas dependent upon its specific gravity.

It is a further object of the invention to provide a purge gas conservation system which is simple but effective in its action.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figures 1, 2:
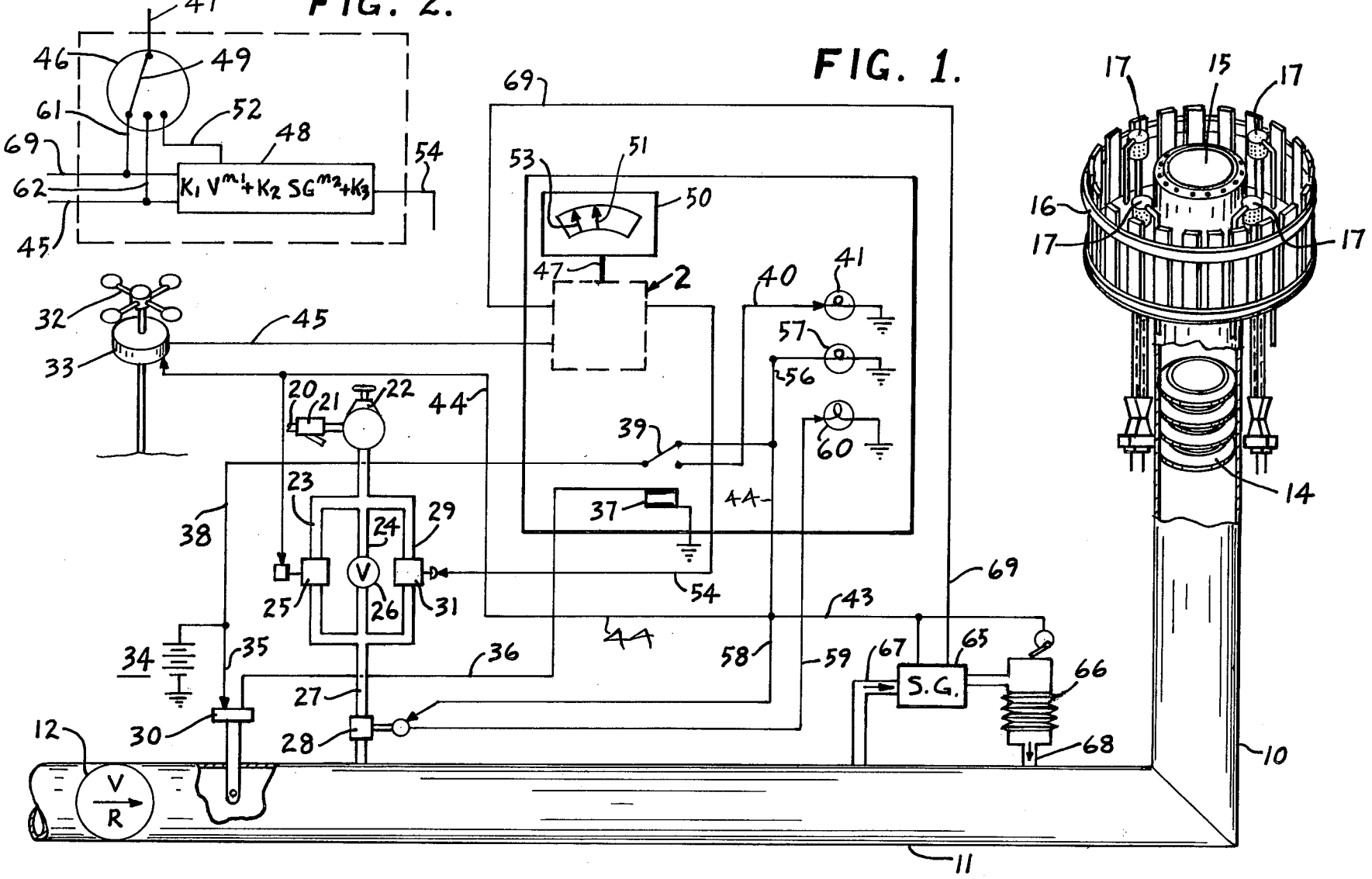
FIG. 1 is a diagrammatic view of a flare gas stack with a purge gas conservation system in accordance with the invention.
FIG. 2 is an enlarged view of a portion of the structure shown at location 2 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

It is common to utilize a flare stack for the disposal of waste combustible gas from chemical and industrial processes and particularly from oil refining. Such stacks may be vertical, horizontal or inclined. The waste combustible gas is not usually continuously available but is intermittently supplied as it becomes necessary to dump such gas.

It has also been common practice to supply purge gas intermittently to the flare stack when waste combustible gas is not being supplied so that air backflow in the stack is minimized, the purging of the stack by waste combustible gas or purge gas minimizing conditions favorable to an explosion within the stack. It is also necessary to take into account the failure of the purge gas supply.

Referring now more particularly to the drawings, a flare stack 10 is illustrated having a supply conduit 11 connected thereto for the supply of waste gas from a waste gas supply connection past a relief valve 12. The waste gas is combustible and is derived from industrial operations and particularly from oil refineries.

The flare stack 10 may be of any desired type, may have a fluidic seal 14 spaced downwardly from the top to permit free upward movement of gas but to provide a substantial obstacle to downflow in the stack 10. A suitable form of seal for this purpose is shown in my U.S. Pat. No. 3,730,673. The flare stack preferably has a burner 15 on the top or discharge end for aiding in the admixture with the waste gas of air for combustion, and with or without steam, and may have a hollow cylindrical slotted wind shield 16 closed at the bottom to protect the pilots 17 and the burners 15 from the wind. Suitable burners are shown in my prior U.S. Pat. Nos. 3,730,673; 3,797,991; 3,822,984 and 3,995,986 but the apparatus of the present invention is applicable to a wide range of burners.

A purge gas supply connection 20 is provided which communicates through a strainer 21 and pressure regulator 22 to divided or branch connections 23, 24 and 29. The purge gas is usually an inert gas, a hydrocarbon gas or a combustible gas with an oxygen content too low to support combustion, or any other suitable gas with insufficient oxygen content for supporting combustion.

The branch connection 23 has a solenoid control valve 25 therein and the branch 24 has a manually operable valve 26 therein. The branch connections 23 and 24 extend to a supply line 27 with a purge failure flow alarm 28 therein which is moved to a closed condition when there is no flow in the conduit 27, as hereinafter pointed out. The branch connection 29 has a proportional control valve 31 responsive to wind speed and specific gravity, as hereinafter explained. The conduit 11 has a flow responsive switch 30 inserted therein, which may be of any desired type, but which is closed when there is gas flow through the conduit 11 and open if there is no flow.

The stack 10, preferably adjacent to its discharge end, has a wind speed responsive impeller 32, preferably an anemometer, which drives a signal source 33 for supplying a wind speed signal for utilization as hereinafter explained.

A source 34 of power is provided connected by a conductor 35 to the flow switch 30 and therethrough by a conductor 36 to the winding 37 of a relay. The power source 34 is also connected by a conductor 38 to the contact 39 actuated by the winding 37, when energized by closing of the flow switch by waste gas flow, to a downward position to establish a circuit through conductor 40 to activate a signal light 41 at the indicating panel 42 to indicate that waste gas flow is occurring and that no purge is needed.

If no waste gas flow is occurring so that the flow switch 30 is in an open position the winding 37 is deenergized and the contact 39 is in its upper position. Power from the source 34 is available through conductor 38, contact 39, conductor 44 for the wind speed responsive signal source 33, through conductor 45, conductor 43 to the specific gravity meter 65 to be described, and conductor 58 to purge failure flow alarm 28, through conductor 59 to purge failure light 60.

The conductor 45 is connected to a manual meter selector switch 46, and to a wind speed signal and specific gravity converting unit 48

The selector switch 46 has a contact 49 which is connected by a conductor 47 through indicating meter 50 for making available a wind speed indication through a pointer needle 51 at an appropriate scale in miles or kilometers per hour when the contact 49 is directly connected to the meter 50 and to conductor 62.

The contact 49 of selector switch 46 can be connected to a conductor 61 for specific gravity.

The purge gas may vary in its specific gravity with respect to air so that if it is lighter than air there is a tendency to rise more rapidly in the stack 10. This makes it desirable to increase the flow for purge gas specific gravities less than one and to decrease the flow for specific gravities greater than one.

In order to determine the specific gravity of the purge gas a specific gravity meter 65 is provided in a pipe 67 connected to the supply conduit 11 with a motor driven pump 66 drawing gas from the conduit 11 and returning the same to the conduit 11 through a return connection 68.

The specific gravity meter 65 and the pump 66 are activated by contact 39 and through conductor 43 when there is purge gas flow and shut off whenever there is waste gas flow.

The meter 65 supplies a signal through a conductor 69 which is connected to the signal converting unit 48 to modify the purge gas delivery inversely to the specific gravity.

The signal converting unit 48 modifies the windspeed signal and the specific gravity signal to provide a purge flow rate signal in standard volumetric units per hour in accordance with the formula $$S_m = K_1 V^{n_1} + K_2 SG^{n_2} + K_3$$

where $S_m$ is the modified signal in terms of purge gas flow $K_1$ is a constant dependent upon the dimensions and other characteristics of the components and takes into account a minimum wind velocity $V^n$ is the $n$th power of the wind velocity at the wind driven impeller 33, and $n \simeq 2$, $K_2$ is a correction constant dependent upon the dimensions and other characteristics of the components for specific gravity $SG$ is the specific gravity of the purge gas as compared to air, and $n_2 \simeq 1$, and $K_3$ is a correction constant dependent on the dimensions and other characteristics of the components The purge gas flow signal is available through a conductor 52 and the contact 49 when positioned to the right for activating an appropriate scale of the purge rate range.

A conductor 54 also extends to the proportional control valve 31 with a signal from unit 48 so that the purge rate may set the proportional valve 26.

The conductor 44 also has a conductor 56 extending therefrom to an indicating lamp 57 which is illuminated when purge gas is required. A conductor 58 extends from the conductor 56 to the purge failure flow alarm 28 for controlling the indicating light 60 through conductor 59 from the alarm 28. The indicating light 60 operates when there is purge failure at the same time that there is no flow of waste gas acting on the switch 30 and through the relay coil 37 and contact 39.

I claim:

1. Control apparatus for a flare gas stack which comprises, in combination with a flare gas stack a connection to said stack from a supply of waste combustible gas for combustion at the discharge end of the stack, a connection to said stack from a supply of purge gas, and waste gas flow sensing and signaling members, means for controlling the supply of purge gas to said stack, said means including a valve member for controlling purge gas delivery from said supply, members responsive to non-flow of waste gas for permitting purge gas flow, windspeed sensing and signaling members, control members for said valve members controlled by said windspeed sensing and signaling members for controlling said purge gas delivery valve members, and indicating means for indicating waste gas flow and purge gas flow.

2. Control apparatus as defined in claim 1 in which a selector member is provided for selective indication of wind speed and purge gas flow.

3. Control apparatus as defined in claim 1 in which said means for controlling the supply of purge gas comprises a manually operable valve in by-pass relation to said valve member.

4. Control apparatus as defined in claim 1 in which a purge flow rate signal is provided with a correction to include a minimum wind velocity.

5. Control apparatus as defined in claim 1 in which said means for controlling the supply of purge gas comprises a proportional control member.

6. Control apparatus as defined in claim 5 in which said proportional control member is controlled by wind speed.

7. Control apparatus for a flare gas stack which comprises, in combination with a flare gas stack, a connection to said stack from a supply of waste combustible gas for combustion at the discharge end of the stack, a connection to said stack from a supply of purge gas, and means for controlling the supply of purge gas to said stack, said means including a valve member for controlling purge gas delivery from said supply, specific gravity sensing means for said purge gas, and control members for said valve member controlled by said specific gravity sensing means for controlling said purge gas delivery valve member.

8. Control apparatus as defined in claim 7 in which a supply conduit is connected to said flare gas stack for delivery of gas thereto, and said specific gravity sensing means is connected to said supply conduit for withdrawal of purge gas for sensing.

9. Control apparatus as defined in claim 7 in which pumping means is provided connected to said specific gravity sensing means for supplying purge gas to said sensing means.

10. Control apparatus as defined in claim 7 in which said means for controlling the supply of purge gas comprises a proportional control member.

11. Control apparatus as defined in claim 10 in which said proportional control member is controlled by specific gravity.

12. Control apparatus as defined in claim 4 in which a specific gravity signal of said purge gas is provided acting with said windspeed signal to determine purge gas flow.

* * * * *